US010046949B2

(12) United States Patent
Moser et al.

(10) Patent No.: US 10,046,949 B2
(45) Date of Patent: Aug. 14, 2018

(54) ELEVATOR INSTALLATION DEFLECTING UNIT

(71) Applicant: Inventio AG, Hergiswil (CH)

(72) Inventors: Christof Moser, Lucerne (CH); Carlos Latorre Marcuz, Shanghai (CN); Gert Silberhorn, Merlischachen (CH); Steven Bian, Shanghai (CN); Wayne Pringle, Queensland (AU); Greg Kennedy, Jakarta Selatan (ID); Sergio Guslandi, Shanghai (CN); Peter Schwarer, South Brisbane (AU)

(73) Assignee: INVENTIO AG, Hergiswil (CH)

( * ) Notice: Subject to any disclaimer, the term of this patent is extended or adjusted under 35 U.S.C. 154(b) by 174 days.

(21) Appl. No.: 14/407,135

(22) PCT Filed: Jun. 5, 2013

(86) PCT No.: PCT/EP2013/061531
§ 371 (c)(1),
(2) Date: Dec. 11, 2014

(87) PCT Pub. No.: WO2013/186092
PCT Pub. Date: Dec. 19, 2013

(65) Prior Publication Data

US 2015/0158703 A1 Jun. 11, 2015

(30) Foreign Application Priority Data

Jun. 12, 2012 (EP) ..... 12171672

(51) Int. Cl.
*B66B 15/02* (2006.01)

(52) U.S. Cl.
CPC ..... *B66B 15/02* (2013.01)

(58) Field of Classification Search
CPC .. B66D 3/04; B66D 3/26; B66B 15/02; B66B 11/008

(Continued)

(56) References Cited

U.S. PATENT DOCUMENTS 1,070,834 A * 8/1913 Nissen ..... B66D 3/046 254/406
2,772,857 A * 12/1956 Bush ..... B66D 3/04 254/413

(Continued)

FOREIGN PATENT DOCUMENTS

| | | |
|---|---|---|
| EP | 1988047 A1 | 11/2008 |
| JP | 59170572 U | 11/1984 |
| WO | 2010103165 A1 | 9/2010 |

*Primary Examiner* — Michael A Riegelman
(74) *Attorney, Agent, or Firm* — William J. Clemens; Shumaker, Loop & Kendrick, LLP

(57) ABSTRACT

A deflection unit for guiding and deflecting the support apparatus of an elevator system includes a deflection roller and an axle which is mounted on a carrier and on which the deflection roller is mounted and is freely rotatable. The axle has an axle head that axially secures the axle on one end. For torsion-free mounting of the axle, a securing member is bolted onto the carrier and supported on an anti-rotation safeguard section arranged on the axle head. A horseshoe-shaped retaining part as a retaining means for axially securing the axle on the carrier is mounted on the axle on the end opposite from the axle head. An annular securing member, which is connected by bolts to the retaining part, is used for securing the retaining part.

19 Claims, 3 Drawing Sheets

(58) Field of Classification Search
USPC ..... 187/266
See application file for complete search history.

(56) References Cited

U.S. PATENT DOCUMENTS

| | | | | | |
|---|---|---|---|---|---|
| 3,337,188 | A * | 8/1967 | Manson | B66D 3/04 | 254/412 |
| 4,614,332 | A * | 9/1986 | Wilson | B66D 3/046 | 254/405 |
| 5,035,300 | A * | 7/1991 | Chapelain | B66B 11/0005 | 116/321 |
| 6,405,833 | B1 * | 6/2002 | Baranda | B66D 3/08 | 187/251 |
| 7,669,835 | B2 * | 3/2010 | Thompson | F16B 45/00 | 254/402 |
| 8,839,912 | B2 * | 9/2014 | Dominguez | B66B 11/0206 | 187/266 |
| 2006/0042885 | A1 | 3/2006 | Kawaskaki et al. | | |
| 2006/0231347 | A1 * | 10/2006 | Mustalahti | B66B 15/02 | 187/266 |
| 2008/0289908 | A1 * | 11/2008 | Murao | B66B 11/0206 | 187/266 |
| 2011/0308892 | A1 * | 12/2011 | Saarelainen | B66B 15/02 | 187/266 |

* cited by examiner

ELEVATOR INSTALLATION DEFLECTING UNIT

FIELD

The invention relates to an elevator installation with a car and a counterweight supported by a support means, wherein at least one of the car and the counterweight is connected with the support means by at least one deflecting unit.

BACKGROUND

Elevator installations are usually installed in a shaft in a building and serve for the transport of persons or goods. The car, which is movable in vertical direction in the shaft, is supported by support means in the form of, for example, cables or belts, wherein the support means are, for movement of the car, connected with a drive. Depending on the respective design of the elevator installation the car and/or a counterweight connected with the car by way of the support means is or are connected with the support means by way of one or more deflecting units. In the case of a 2:1 suspension, for example, one or two deflecting units are associated with the car and one deflecting unit is associated with the counterweight.

Deflecting units comprise one or more deflecting rollers which are mounted to be freely rotatable with use of, for example, roller bearings. The axle is fastened to a support at which the car or the counterweight is hung or suspended. This axle fastening can lead to problems with the deflecting units known for elevator installations. In rare cases it can happen that, for example, if maintenance has been deficient or omitted the deflecting roller no longer can freely rotate with respect to the axle, as a result of which high levels of torque between deflecting roller and axle can arise. This can have a negative effect on the axle fastening. In extreme cases the axle could migrate out of the support, which could lead to accidents.

A deflecting unit with a deflecting roller freely rotatable about an axis of rotation and mounted by way of axle on a support has become known from WO 2010/103165 A1 and has—with respect to a center plane running vertically relative to the axis of rotation of the deflecting roller—a mirror-symmetrical form of the axle. For axial securing, the axle, which is formed by a cylindrical body, has on two sides grooves in which the support engages directly or indirectly by way of a retaining part fastened to the support. The circumferential surface of the axle is interrupted by a planar section, which outwardly adjoins the respective groove and which is supported at a securing element screw-connected with the support and formed by a plate. The securing elements have the purpose of ensuring rotationally secure mounting of the axle. After failure of the rotational securing due to wear, according to a description in WO 2010/103165 the axle, which is firmly held by way of the grooves in the support, shall allow rotation of the axle. However, depending on the respective construction the desired axial securing is not provided, is insufficient or is achievable only by constructional solutions which are costly.

SUMMARY

It is accordingly an object of the present invention to avoid the disadvantages of the prior art and, in particular, to create an elevator installation by which operational reliability can be increased. The deflecting unit for the elevator installation shall, in addition, be of simple construction and able to be produced simply as well as characterized by a robust construction.

According to the invention this object is fulfilled by an elevator installation with the features described below. Due to the fact that retaining means for axial securing of the axle to the support are provided on both sides of the axle, between which retaining means the support is received preferably with slight play and which retaining means allow rotation of the axle with respect to the support, operational reliability and the service life of the elevator installation can be increased or improved. Since due to the mentioned retaining means at least for special operational states (for example after the installation was improperly maintained or not maintained and accordingly the deflecting roller suddenly and unpredictably can no longer fully freely rotate) a rotation of the axle in the support is possible the risk of operational disturbances or accidents can be substantially reduced. It is ensured by this arrangement that unintended escape of the axle from the support, due to axial migration in the case of excessive mechanical loading, can be virtually excluded. With particular advantage, the axle arrangement and axle fastening according to the invention is employed in the deflecting unit associated with the counterweight. The retaining means is formed on one side by an axle head, which is formed on the axle, for formation of a shoulder-like abutment for the support. For axial securing of the axle in the support, another retaining means is used on the opposite side. The axle with the axle head is preferably of monolithic construction and consists of, for example, a metallic material. The axle can be a substantially rotationally symmetrical axle body of steel. The axle thus has a mushroom-shaped configuration, wherein the axle comprises the mentioned axle head ('mushroom cap') adjoined in axial direction by an axle shank. The axle head is, for example, of substantially cylindrical construction and has a larger diameter than the axle shank. A retaining means rigidly connected with the axle in that manner leads to a particularly high degree of stability of the axle fastening. The axle head can in simple manner be dimensioned in such a way that breaking-off or another form of destruction of the axle head is virtually impossible even in the case of extraordinarily strong mechanical loads during operation of the elevator. The axle arrangement with the mushroom-shaped axle body is, moreover, simple to handle and enables simple and quick assembly and disassembly.

In a first form of embodiment at least the axle head and/or the (arranged on the opposite side) retaining means can, for rotationally secure mounting of the axle in a first life cycle, be fixed by rotational securing means to be secure against rotation with respect to the support. With an arrangement of that kind the respective deflecting unit can operate in optimum manner at least in the first life cycle. For example, the deflecting roller can rotate with low output of noise and with little wear. However, depending on the respective field of use it can obviously also be sufficient if the axle, which is fitted in the bearing mounts of the support, is prevented—due to the significantly higher (by comparison with, for example, the roller-bearing arrangement) friction between axle and support—from rotating in normal operation during car travel.

It can be advantageous if at least one deflecting unit is constructed so that in the case of exceeding a specific torque between deflecting roller and axle the rotational securing means releases the corresponding retaining means (or the retaining means associated with the rotational securing means) and the axle in a second life cycle is rotatably mounted in the support between the retaining means. The service life of the axial fastening of the deflecting unit is thus distinguished by two life cycles. In the first life cycle, which approximately corresponds with the normal state, the axle cannot rotate in the support. In the second life cycle following thereupon, which approximately corresponds with an emergency operational state, the axle can rotate in the support, wherein as before the axial securing of the axle in the support is ensured. Through division of the service life into two cycles better monitoring of the deflecting unit is possible. In the second life cycle it can happen that the axle due to wear frets to a certain degree in the support and a slot vertically extending to greater or lesser extent in the support arises. This phenomenon can be easily observed, whereby monitoring of the deflecting unit is simplified for maintenance personnel.

The rotational securing means could, for example, comprise an operating mechanism which can be triggered in the case of exceeding the afore-mentioned excess torque and thus release the retaining means. However, it can be particularly advantageous if the rotational securing means is executed as a frangible element. A rotational securing means of that kind can, for example, comprise a comparatively tightly dimensioned screw which breaks under the action of high shear forces if the predetermined torque between deflecting roller and axle is exceeded. However, other frangible elements would obviously be conceivable.

For rotationally secure mounting of the axle this can be achieved if the axle head has a rotational securing section which is preferably predefined by a planar surface and which is supported at a securing element fastened to the support. The rotational securing section can be arranged in the circumferential region of the axle head. If, for example, the axle head has a cylindrical external form the rotational securing section can be formed by milling the cylindrical circumferential surface in simple mode and manner. Instead of a rotational securing section created by milling, the axle head can also have a rotational securing section which protrudes in radial direction and which is fastened to the support by means of, for example, a screw connection.

The securing element can be a body which is preferably formed by a plate and which is fastened to the support by way of at least one screw. This screw can be constructed as a frangible element which can break under the action of excessive shear forces and thus cancel the rotational securing of the axle.

It can be advantageous if the securing element is secured to the support by a single screw. With the single-screw arrangement the desired target breaking value at which the rotational securing is to be cancelled can be set in particularly simple manner.

The screw can be oriented axially parallelly to the axle in such a manner that, at least for a first life cycle—in which the axle is arranged in the support to be rotationally fast—screw and axle lie on a surface normal of the rotational securing section.

Moreover, it can be advantageous if the retaining means on at least one side is formed by a separate component. Simple assembly and disassembly of the deflecting unit is ensured in this way.

The retaining means can be formed on at least one side by a retaining part surrounding the axle in radial direction. The retaining part surrounding the axle can be mounted on the axle and removed again in simple manner. It can be particularly advantageous if the retaining part is formed to be horseshoe-shaped or annular.

For rotationally secure retention of the retaining part on the axle the horseshoe-shaped retaining part can have planar flanks and the axle can have mechanically positive coupling sections which are executed to be complementary to the flanks and which are preferably created by milling. The horseshoe-shaped retaining part can be mounted in simple manner in radial direction on the axle from outside.

The axle can have a groove for receiving the horseshoe-shaped retaining part. The groove ensures precise positioning of the retaining part on the axle.

For securing the retaining part, a securing part surrounding the axle in radial direction can be provided and is connected with the retaining part preferably by means of screws. The securing part can in that case be of annular form.

DESCRIPTION OF THE DRAWINGS

Further individual features and advantages of the invention are evident from the following description of an embodiment and from the drawings, in which.

DETAILED DESCRIPTION

Figure 1:
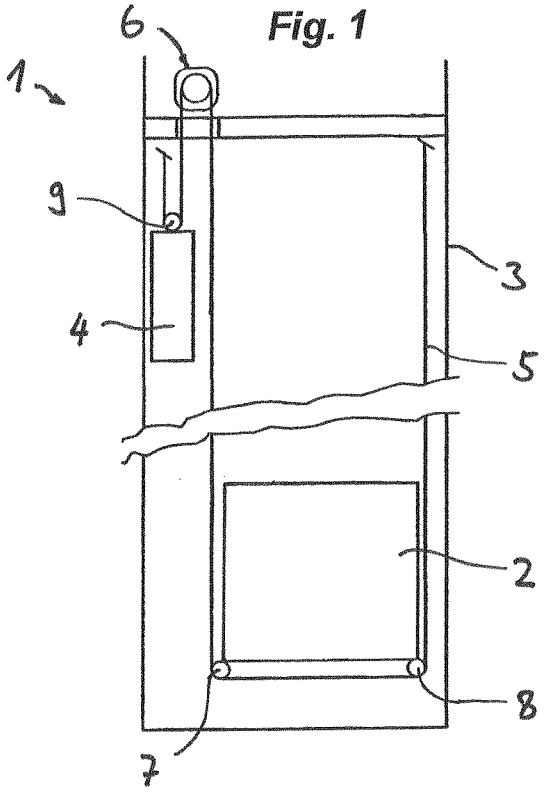
FIG. 1 shows a simplified illustration of an elevator installation in a side view.

FIG. 1 shows an elevator installation, which is denoted overall by 1, in a substantially simplified and schematic illustration. The elevator comprises a car 2, which is vertically movable up and down, for the transport of persons or goods. Support means or apparatus 5 for supporting the car and a counterweight 4 can be a cable or several cables. Obviously, however, other support means, for example in the form of belts, are also conceivable. The car 2 and the counterweight 4 are respectively connected by way of deflecting units 7, 8, 9 with the support means. For moving the car 2 and the counterweight 4 use is made of a drive 6, for example a drive-pulley drive, which, for example, is arranged in a separate engine room in the region of the shaft head of an elevator shaft 3. The specific deflecting units described in more detail in the following would obviously also be suitable for other elevators and, in particular, also for so-called engine-room-less elevators. The elevator installation 1 illustrated in FIG. 1 is constructed in a 2:1 suspension configuration. However, other suspension variants (for example 1:1, 4:1, etc.) would obviously also be conceivable. Moreover, a deflecting unit could also be arranged in the region of the car roof instead of the under-looping of the car 2 shown in FIG. 1.

Figure 2:
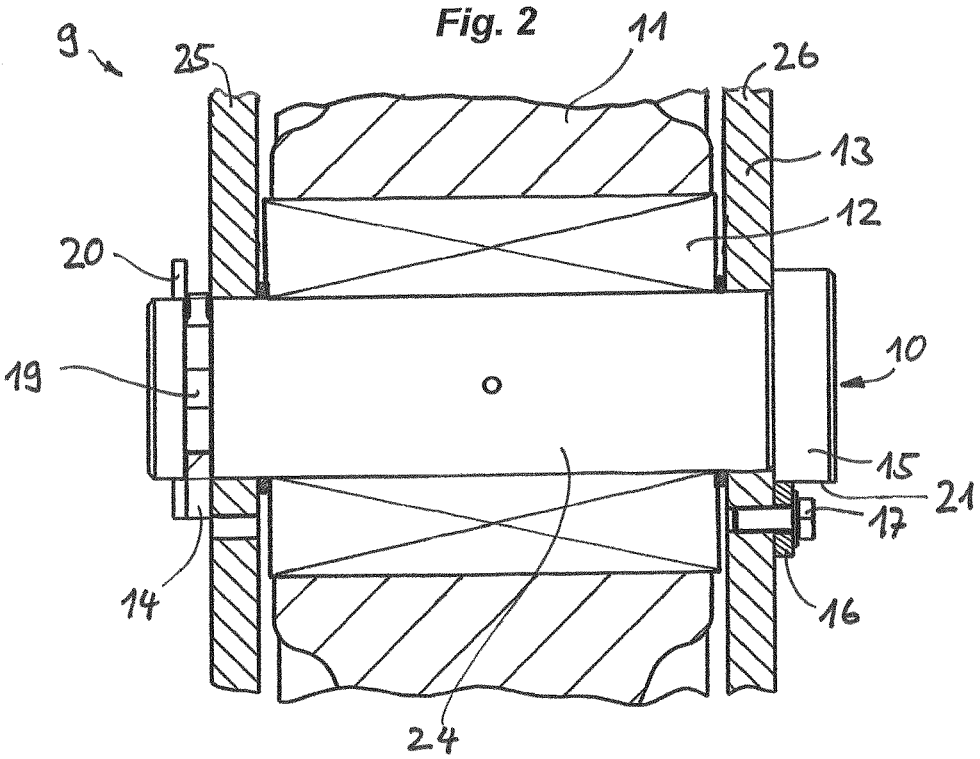
FIG. 2 shows a detail of a cross-section through a deflecting unit of the elevator installation according to FIG. 1.

Technical details with respect to the construction of a deflecting unit are apparent from FIG. 2. FIG. 2 shows the region of the rotational axle of the deflecting unit 9, which is associated with the counterweight and at which the counterweight (not illustrated here) is suspended by way of the support 13. The deflecting unit illustrated here could, however, also be associated with the car (7, 8; cf. FIG. 1) or even be arranged at another location in the elevator installation. The deflecting unit 9 comprises a deflecting roller 11, at the circumference of which the support means (not illustrated here) is guided and deflected. The deflecting roller 11 is connected with an axle 10 by way of a bearing 12 and mounted on the axle 10 to be freely rotatable. The bearing 12 can, for example, contain one or more roller bearings depending on the respective requirements. The axle 10 is fastened to the support 13. The support 13 is connected with the counterweight (not illustrated). The support 13 has two mutually opposite walls 25 and 26, which are each provided with a respective bearing receptacle, through which the axle 10 is guided. The axle 10 is secured in axial direction on both sides or ends. On one side, the retaining means for axial securing of the axle at the support is formed by an axle head 15, which is integral with the axle 10 and predefines a shoulder-like abutment. On the opposite side, the axial securing is achieved by a retaining part 14 mounted on the axle. The securing part denoted by 20 serves for securing the retaining part 14 in the illustrated position.

The axle 10 is connected with the support 13 to be secure against rotation, wherein the rotational securing acts merely on one side of the axle. This rotational securing secures the securing element which is denoted by 16 and which is screw-connected with the support 13. The axle head 15 has a rotational securing section 21, which is predefined by a planar surface and which is supported at the securing element 16. The securing element 16 is fastened to the support 13 by way of a screw connection.

Figure 3:
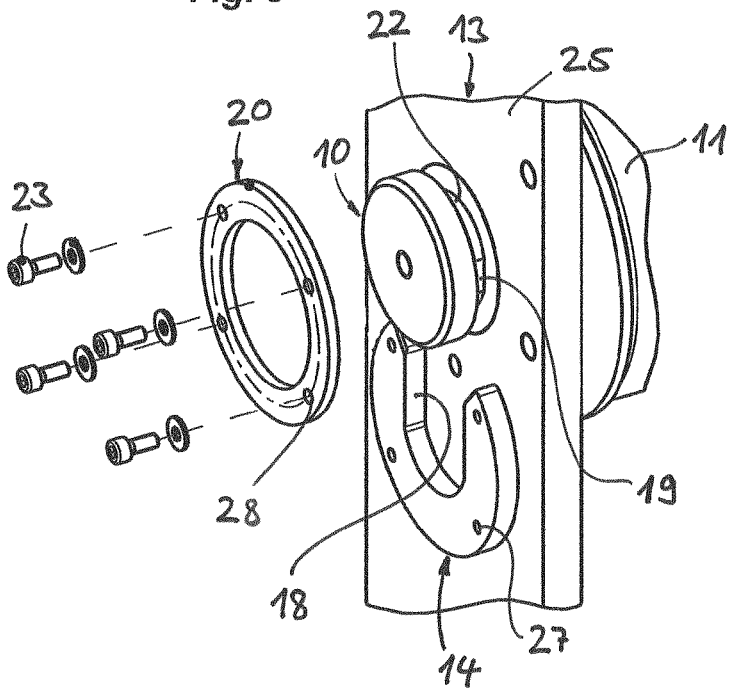
FIG. 3 shows a perspective view of one side of the deflecting unit of FIG. 2 in a partly exploded illustration.

It is evident from FIG. 3 that, inter alia, the retaining part 14 is of horseshoe-shaped design. The horseshoe-shaped retaining part 14 has mutually opposite parallel flanks 18, which co-operate with complementary mechanically positive coupling sections 19 and thus ensure rotationally fast fixing of the retaining part 14 in the finally assembled position. In inserted position, the retaining part 14 surrounds the axle 10 with respect to the radial direction predefined by the axle. The securing part 20 is of annular form and includes four passage holes 28, which correspond with the threaded bores 27 and through which the screws 23 are insertable. The retaining part 14 is provided with receptacles, which are formed as threaded bores, for fastening screws 23. As an alternative to the variant shown here, the retaining part could be designed to be annular and the securing part to be horseshoe-shaped.

Figure 4:
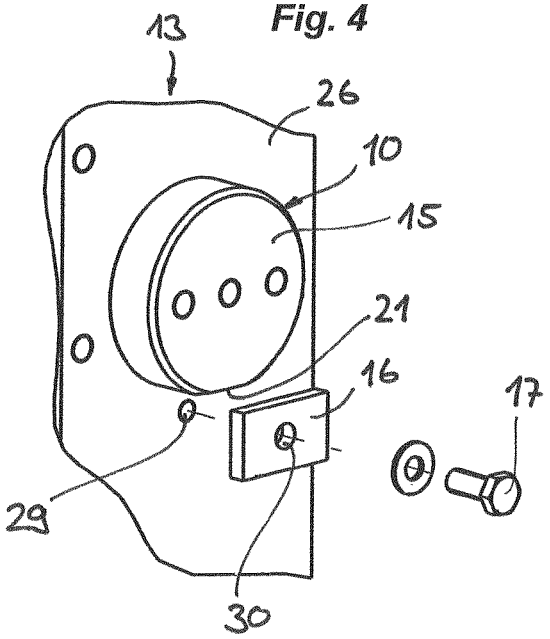
FIG. 4 shows the other side of the deflecting unit of FIG. 2

As FIG. 4 shows, the securing element 16 is formed by a plate-like body. Instead of the rectangular plate illustrated in plan view, other forms could also be selected for the component 16. It is to be noted that the securing element 16 has an edge or section which co-operates with the rotational securing section 21 of the axle 10 and rests thereon. The securing element 16 has a hole 30 through which the screw 17 is introducible and can then be screwed into the threaded bore 29 in the wall 26 of the support 13. The axle head of substantially cylindrical construction has the rotational securing section 21 created by a chamfering.

The screw 17 represents a frangible element which under the action of excessive shear forces, for example when the deflecting roller suddenly and unpredictably can no longer rotate and a specific torque between deflecting roller and axle is exceeded, breaks and thereby the rotational securing of the axle 10 is cancelled. The mentioned torque can be set in simple manner by the selection and dimensioning of the screw 17. Thanks to the two lateral retaining means, i.e. the axle head 15 on one side and the retaining means 14 on the other side, the axle is, as before, secured against undesired movement in axial direction. If maintenance personnel discover the axle rotating in the support, they can institute repair or reconditioning measures. After release of the rotational securing the axle 10 is thus, in a second life cycle of the deflecting unit, received in the support to be rotatable. Tests have shown that the rotating axle can after some time fret to a certain degree in the support 13 due to wear and a slot extending vertically to greater or lesser extent in the support 13 can arise. Thanks to the special axle arrangement, however, axle securing is guaranteed at all times so that the axle cannot fall or migrate out of the support. The slot which in a given case might arise also allows simple monitoring of the deflecting unit.

Instead of the rotational securing section created by chamfering shown in FIG. 4, the axle head could also comprise a rotational securing section protruding in radial direction or a special shaping in circumferential direction. For example, the plate body denoted in FIG. 4 by 16 could be welded to the axle head. This rotational securing means integrated with or in the axle head would—analogously to the embodiment according to FIG. 4—have to be fastened to the support merely by a screw.

For specific applications the special securing means shown by way of example in FIG. 4 are not necessary, because it can be sufficient if the axle fitted in bearing mounts of the support is prevented, due to the significantly higher level of friction between axle and support, from rotating in normal operation during cage travel. The axle head of the embodiment according to FIG. 4 could in this case have a cylindrical external form without chamfering and the bearing unit would not have to have a securing element. After a bearing defect, the friction in the roller bearing or bearings would be greater than that between axle and support, whereupon the axle could rotate in the support. Screw 17 and an axle shank 24 extend axially parallel in a plane normal of the planar surface of the rotational securing section.

Figure 5:
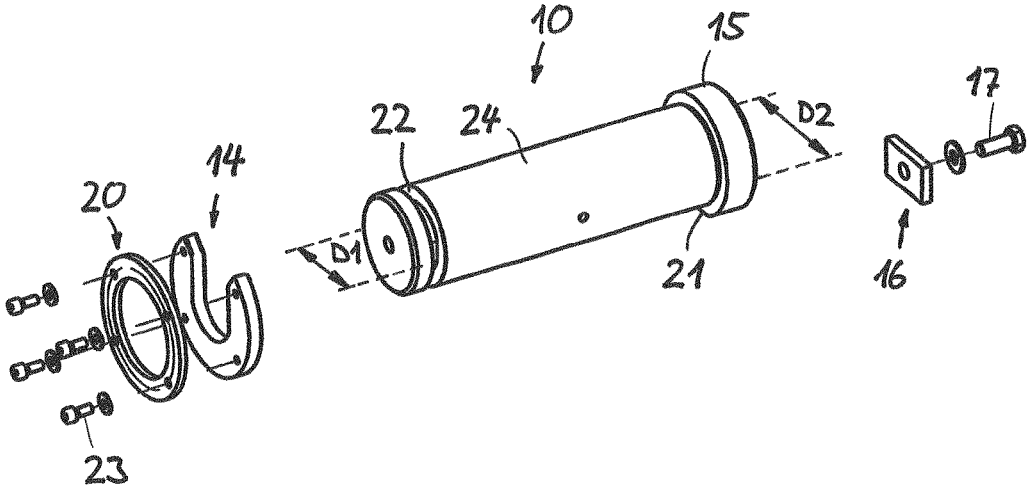
FIG. 5 shows a perspective exploded illustration of the axle arrangement for the deflecting unit according to FIG. 2.

FIG. 5 shows the individual components of the axle arrangement containing the axle 10 with the axle head 15 formed at the axle, the securing element 16 designed as a plate, the retaining part 14 and the securing part 20. The axle 10 is, as apparent, formed to be mushroom-shaped, wherein the axle head 15 forms the 'mushroom cap'. The axle shank 24 adjoining the axle head in axial direction has a smaller diameter D1 by comparison with the diameter D2 of the axle head 15. The axle shank 24 can be fitted into corresponding bearing receptacles of the support. A mushroom-shaped axle of that kind can be produced economically. The axle can be made in simple manner from a metallic material (for example steel) by a material-removing process (turning, milling, etc.).

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator installation having a car, a counterweight and a support apparatus supporting the car and the counterweight, wherein at least one of the car and the counterweight is connected with the support apparatus by at least one deflecting unit, the at least one deflecting unit comprising:

a deflecting roller;

an axle fastened to a support and on which the deflecting roller is mounted to be freely rotatable, the axle being of mushroom-shaped form having an axle shank with an axle head at one end forming an abutment, the axle head having a radius greater than a radius of a remainder of the axle, the support having two mutually opposite walls, each wall provided with a respective bearing receptacle through which the axle is guided, the axle head forming a shoulder-like abutment with one of the walls;

a retaining part on an end of the axle opposite the axle head, whereby the support is received between the axle head and the retaining part, and the axle head and the retaining part allow rotation of the axle with respect to the support;

wherein the axle head is, for rotationally secure mounting of the axle, fixed in a first life cycle by a securing element fastened to the support to be secure against rotation in the support, and the securing element is releasably fastened to the support by a frangible element.

2. The elevator installation according to claim 1 wherein the at least one deflecting unit is configured so that if a specific torque between the deflecting roller and the axle is exceeded the securing element releases the axle head and the axle is, in a second life cycle, rotatable in the support.

3. The elevator installation according to claim 1 wherein the axle head has a rotational securing section formed as a planar surface and which is supported on the securing element fastened to the support.

4. The elevator installation according to claim 3 wherein the securing element is formed as a plate fastened to the support by a screw that is the frangible element.

5. The elevator installation according to claim 3 wherein the securing element is fastened to the support by a screw aligned axially parallel to the axle and wherein the screw and the axle lie in a plane normal to the planar surface of the rotational securing section.

6. The elevator installation according to claim 1 wherein the retaining part is surrounding the axle.

7. The elevator installation according to claim 6 wherein the retaining part is formed as horseshoe-shaped or annular.

8. The elevator installation according to claim 6 wherein for rotationally secure retention of the retaining part at the axle the retaining part is horseshoe-shaped and has planar flanks, and the axle has coupling sections formed complementary with the flanks.

9. The elevator installation according to claim 6 wherein the axle has a groove for receiving the retaining part and the retaining part is horseshoe-shaped.

10. The elevator installation according to claim 1 including a securing part surrounding the axle in radial direction and connected with the retaining part.

11. The elevator installation according to claim 10 wherein the securing part is connected with the retaining part by screws.

12. The elevator installation according to claim 10 wherein the securing part is annular.

13. The elevator installation according to claim 1 wherein the axle and the axle head are of monolithic construction.

14. An elevator installation having a car, a counterweight and a support apparatus supporting the car and the counterweight, wherein at least one of the car and the counterweight is connected with the support apparatus by at least one deflecting unit, the at least one deflecting unit comprising:

a deflecting roller for guiding and deflecting the support apparatus;

a support;

an axle fastened to the support and on which the deflecting roller is mounted to be freely rotatable, the axle being of mushroom-shaped form having an axle shank with an axle head at one end forming an abutment, the axle head having a radius greater than a radius of a remainder of the axle, the support having two mutually opposite walls, each wall provided with a respective bearing receptacle through which the axle is guided, the axle head forming a shoulder-like abutment with one of the walls;

a retaining part on an end of the axle opposite the axle head, whereby the support is received between the axle head and the retaining part, and the axle head and the retaining part allow rotation of the axle with respect to the support; and a securing element fastened to the support and securing the axle head against rotation in the support in a first life cycle of the at least one deflecting unit, and upon a specific torque existing between the deflecting roller and the axle being exceeded the securing element releases the axle head and the axle is, in a second life cycle, rotatable in the support, wherein the securing element is releasably fastened to the support by a frangible element.

15. The elevator installation according to claim 14 wherein the axle head has a rotational securing section formed as a planar surface and which is supported on the securing element fastened to the support.

16. The elevator installation according to claim 15 wherein the securing element is formed as a plate fastened to the support by a screw that is frangible.

17. The elevator installation according to claim 15 wherein the securing element is fastened to the support by a screw aligned axially parallel to the axle and wherein the screw and the axle lie in a plane normal to a planar surface of the rotational securing section.

18. The elevator installation according to claim 14 wherein for rotationally secure retention of the retaining part at the axle the retaining part is horseshoe-shaped and has planar flanks, and the axle has coupling sections formed complementary with the flanks, and including an annular securing part surrounding the axle in radial direction and connected with the retaining part.

19. The elevator installation according to claim 14 wherein the axle and the axle head are of monolithic construction.

* * * * *